US010864966B2

(12) United States Patent
O'Rourke

(10) Patent No.: US 10,864,966 B2
(45) Date of Patent: Dec. 15, 2020

(54) ROTATABLE CHAIN STOPPER

(71) Applicant: Charlie O'Rourke, Goleta, CA (US)

(72) Inventor: Charlie O'Rourke, Goleta, CA (US)

(73) Assignee: Bardex Corporation, Goleta, CA (US)

( * ) Notice: Subject to any disclaimer, the term of this patent is extended or adjusted under 35 U.S.C. 154(b) by 0 days.

(21) Appl. No.: 16/360,580

(22) Filed: Mar. 21, 2019

(65) Prior Publication Data

US 2019/0270496 A1 Sep. 5, 2019

Related U.S. Application Data

(63) Continuation of application No. 15/603,293, filed on May 23, 2017, now Pat. No. 10,272,973.

(60) Provisional application No. 62/348,597, filed on Jun. 10, 2016, provisional application No. 62/340,068, filed on May 23, 2016.

(51) Int. Cl.

| | |
|---|---|
| ***B63B 21/18*** | (2006.01) |
| ***B63B 21/50*** | (2006.01) |
| ***B66D 1/28*** | (2006.01) |
| ***B66D 1/72*** | (2006.01) |

(52) U.S. Cl.

CPC ..... *B63B 21/18* (2013.01); *B63B 21/50* (2013.01); *B66D 1/28* (2013.01); *B66D 1/72* (2013.01)

(58) Field of Classification Search

CPC ..... B63B 21/00; B63B 21/04; B63B 21/18; B63B 21/22; B63B 21/50; B66D 1/00; B66D 1/28; B66D 1/72; F16G 15/00; F16G 15/04

USPC ..... 114/199, 200

See application file for complete search history.

(56) References Cited

U.S. PATENT DOCUMENTS

| | | | | |
|---|---|---|---|---|
| 3,289,626 | A * | 12/1966 | Petrie | B63B 21/18 114/200 |
| 3,620,181 | A | 11/1971 | Naczkowski | |
| 3,805,728 | A | 4/1974 | Abraham | |
| 4,186,464 | A | 2/1980 | Sandoy | |
| 5,845,893 | A | 12/1998 | Groves | |
| 6,439,146 | B2 | 8/2002 | Seaman et al. | |
| 7,284,496 | B1 | 10/2007 | Douceur | |
| 8,893,636 | B2 * | 11/2014 | Tomas | B63B 21/18 114/200 |
| 8,915,205 | B2 | 12/2014 | Miller et al. | |
| 9,126,659 | B2 | 9/2015 | Miller et al. | |

(Continued)

FOREIGN PATENT DOCUMENTS

WO 2016075291 A1 5/2016

OTHER PUBLICATIONS

Supplementary EP Search Report issued in EP Application No. 17803460.9 dated Dec. 6, 2019 [6 Pages].

(Continued)

*Primary Examiner* — Lars A Olson

(74) *Attorney, Agent, or Firm* — Michael S. McCoy; Amatong McCoy LLC

(57) ABSTRACT

A rotatable chain stopper includes a base, an actuator operatively coupled to the base, and a pair of latches pivotably coupled to the base. The orientation of the base and position of the latches are responsive to extension of the actuator. The rotatable chain stopper may be used as a portion of chain jack assembly, such as on an offshore vessel. The rotatable chain stopper may used in a method of pulling-in, paying-out, and positioning of an anchor chain, such as for mooring an offshore vessel.

19 Claims, 12 Drawing Sheets

(56) References Cited

U.S. PATENT DOCUMENTS

| | | | | |
|---|---|---|---|---|
| 9,783,268 | B2 * | 10/2017 | Witteman | B63B 21/04 |
| 2014/0026796 | A1 | 1/2014 | Leverette et al. | |
| 2015/0000581 | A1 * | 1/2015 | Mol | B63B 21/04<br>114/230.23 |
| 2015/0090171 | A1 | 4/2015 | Dang | |
| 2017/0259886 | A1 | 9/2017 | O'Rourke et al. | |

OTHER PUBLICATIONS

Notification of Transmittal of International Search Report and Written Opinion dated Aug. 22, 2017 (issued in PCT Application No. PCT/US2017/034078) [13 pages.].

* cited by examiner

ROTATABLE CHAIN STOPPER

CROSS-REFERENCE TO RELATED APPLICATIONS

The present application is a Continuation of U.S. application Ser. No. 15/603,293, filed on May 23, 2017 (allowed), which claims the benefit of U.S. Provisional Patent Application No. 62/340,068, filed on May 23, 2016 (now expired) and of U.S. Provisional Patent Application No. 62/348,597, filed on Jun. 10, 2016 (now expired), of which the entireties of each are incorporated herein by reference.

FIELD

The present disclosure relates to chain stoppers for use with chain jacks or windlasses, both rotary and linear, and to methods of use of the same.

BACKGROUND

Chain jacks or windlasses are typically used to move heavy weight. One type of windlass, mooring windlasses, are used to pull-in or pay-out mooring lines to moor offshore vessels. Offshore mooring systems are typically used to maintain offshore structures in position (i.e., on station) within specified tolerances. Offshore structures, such as floating production, drilling or construction platforms or spar buoys, generally are moored in a desired location through the use of mooring lines (e.g., chains or cables) secured between the offshore structure and anchors on the ocean floor. Mooring systems operate to provide restoring forces that act against environmental forces (e.g., wind, waves and currents) that move offshore structures out of position (i.e., off station).

Enhanced control over the positioning of mooring lines may correspondingly enhance control over the positioning of associated offshore structures.

BRIEF SUMMARY

An embodiment of the present disclosure relates a rotatable chain stopper. The rotatable chain stopper includes a base, an actuator that is operatively coupled to the base, and a pair of latches that are pivotably coupled to the base.

Another embodiment of the present disclosure relates to a chain jack assembly. The chain jack assembly includes a chain jack and a rotatable chain stopper. The rotatable chain stopper includes a base, an actuator operatively coupled to the base, and a pair of latches pivotably coupled to the base.

A further embodiment of the present disclosure relates to a method of positioning an anchor chain using a chain jack assembly that includes a chain jack and a rotatable chain stopper. The rotatable chain stopper includes a base, an actuator operatively coupled to the base, and a pair of latches pivotably coupled to the base. The method includes pulling-in, paying-out, or combinations thereof the anchor chain using the chain jack. The method includes positioning the pair of latches to grip a link of the anchor chain. If the link is a vertical link, the pair of latches are positioned in a first position. If the link is a flat link, the pair of latches are positioned in a second position. Moving the pair of latches from the first position to the second position includes rotating the rotatable chain stopper by 90 degrees. The method includes gripping the link of the anchor chain with the pair of latches.

Some embodiments relate to a chain mooring windlass including a windlass frame, a chain wheel, a chain wheel axel extending through and operatively coupled to the chain wheel and rotatably coupled to the windlass frame, and drive assemblies operatively coupled to the chain wheel axel. The chain mooring windlass also includes a chain stopper configured to selectively rotate into: an open configuration allowing passage of a chain through an opening formed by the chain stopper; and a closed configuration with the chain stopper gripping a chain positioned within the opening formed by the chain stopper. The chain mooring windlass with the chain stopper may be used in a method of pulling-in, paying-out, positioning, or combination thereof a mooring line.

The foregoing has outlined rather broadly the features and technical advantages of the present disclosure in order that the detailed description that follows may be better understood. Additional features and advantages will be described hereinafter, which form the subject of the claims. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure. The novel features which are believed to be characteristic of the products, systems, and methods, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

So that the manner in which the features and advantages of the system, products, and/or method so of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Products and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice. For example, many of the exemplary descriptions provided herein are concerned with chain jacks for mooring applications. Aspects of the concepts described may, however, be equally applicable to chain jacks for non-mooring applications (e.g., moving heaving loads).

DETAILED DESCRIPTION

Figure 1:
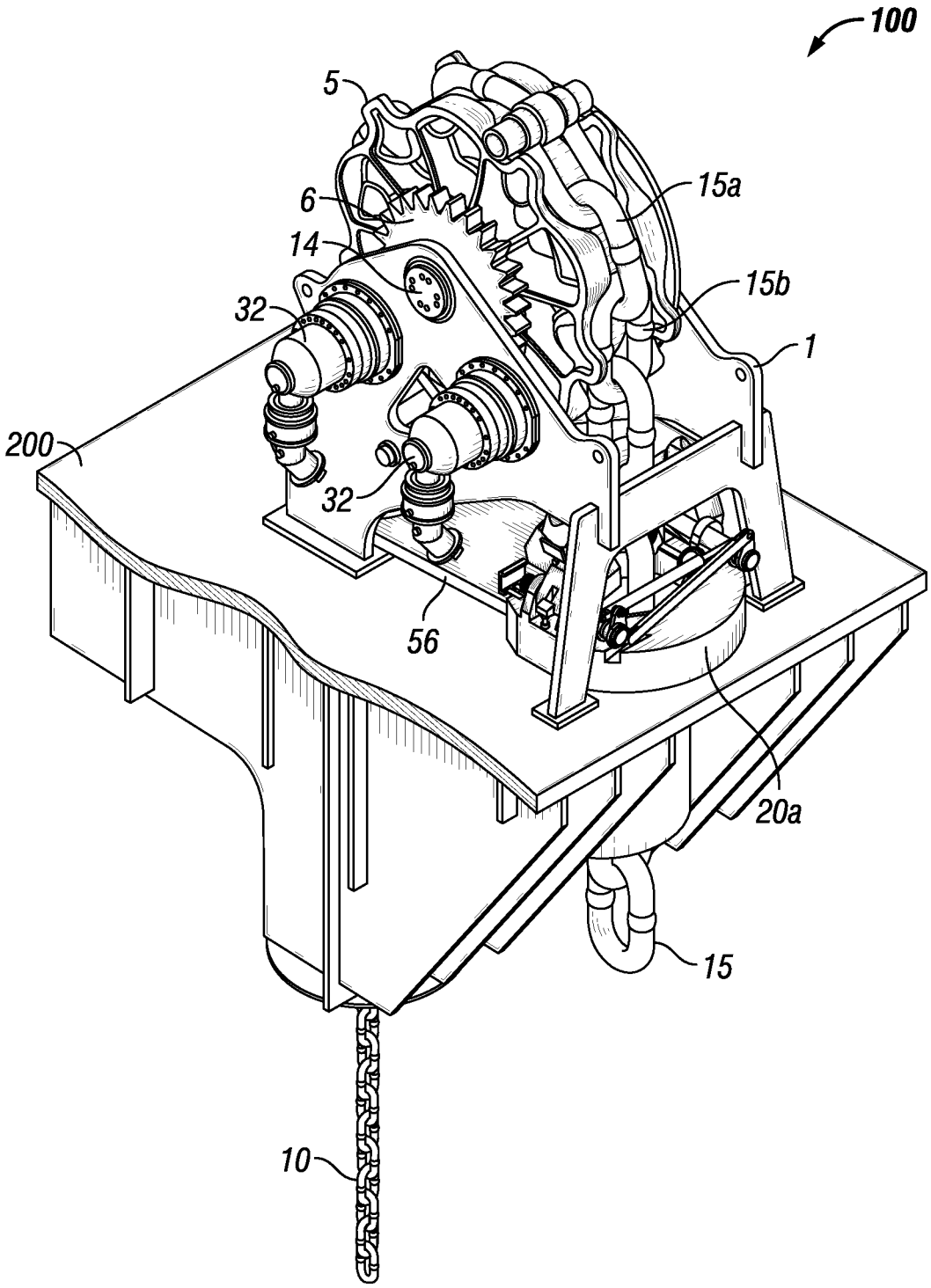
FIG. 1 is a perspective view of a rotary chain jack or windlass including a chain stopper in accordance with certain embodiments of the present disclosure.
Figure 2:
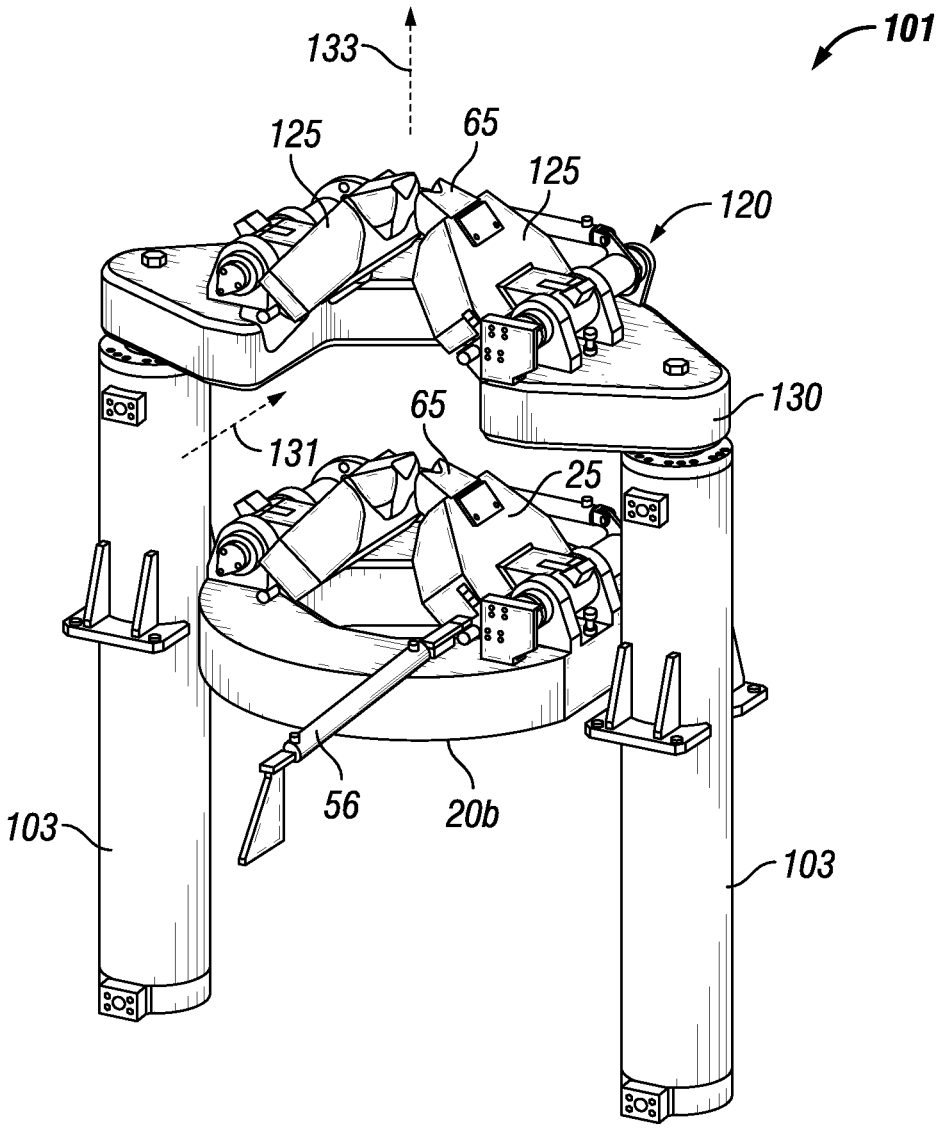
FIG. 2 is a perspective view of a linear chain jack including a chain stopper in accordance with certain embodiments of the present disclosure.
Figure 3:
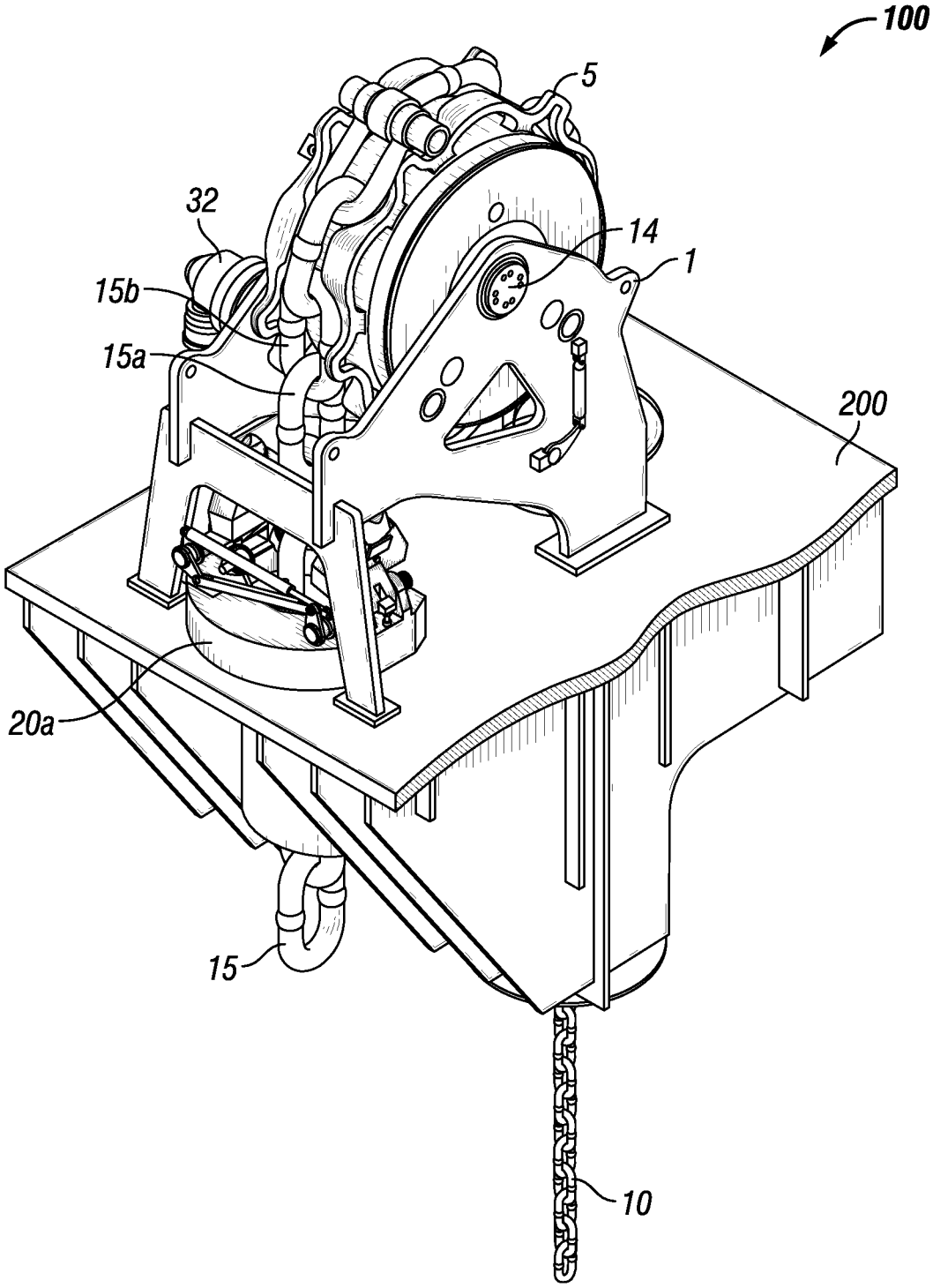
FIG. 3 is another perspective view of the rotary chain jack or windlass of FIG. 1.
Figure 4:
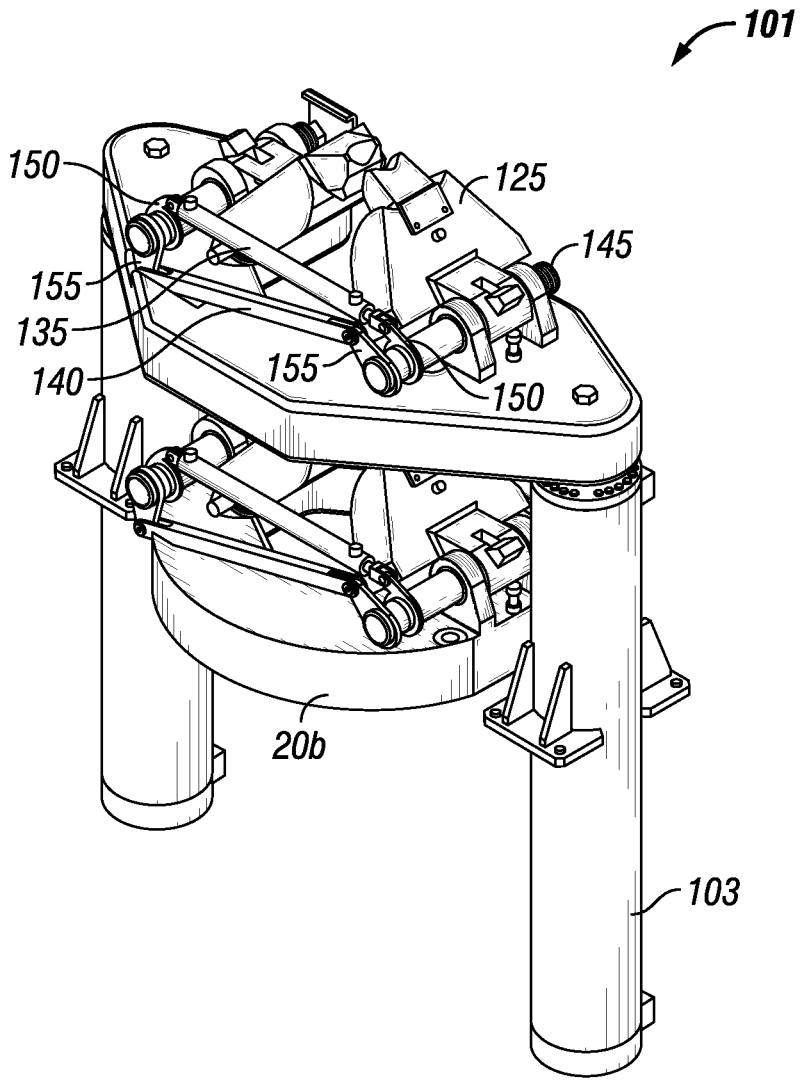
FIG. 4 is another perspective view of the linear chain jack of FIG. 2.

Certain embodiments of the present disclosure include a rotatable chain stopper for use in engaging a chain (e.g., an anchor chain) to, for example, pull-in, pay-out, or position the chain, such as during mooring of an offshore vessel. The rotatable chain stopper may include two opposing stopper latches, and may have an open "C" configuration or a closed configuration. Other embodiments include a chain jack or windlass including the rotatable chain stopper, or to an offshore vessel including such a chain jack or windlass. Still, additional embodiments include methods of use of the rotatable chain stopper, such as for pulling-in, paying-out, positioning, or combination thereof a mooring line. Embodiments of the rotatable chain stoppers disclosed herein may be used with rotary chain jacks or windlasses, as shown in FIGS. 1 and 3, or linear chain jacks, as shown in FIGS. 2 and 4. One skilled in the art would understand that the rotatable chain stoppers disclosed herein are not limited to use with the particular chain jacks shown and described herein.

As used herein, a "rotatable chain stopper" is a chain stopper in which an orientation of the chain stopper can be changed relative to a defined axis and/or a direction of extension of a chain (e.g., an anchor chain). For example, embodiments of the rotatable chain stopper disclosed herein may be reoriented "on the fly" such that latches of the rotatable chain stopper are capable of selectively gripping either vertical or flat links of a chain. As used herein, "flat links" and "vertical links" refer to adjacent links on a chain that are oriented 90 degrees or substantially 90 degrees from one another, as would be well understood by one of ordinary skill in the art with reference to FIG. 1.

Rotary Chain Jack

With reference to FIGS. 1 and 3, an embodiment of a rotary chain jack including the rotatable chain stopper is depicted. Rotary chain jack 100 includes dual chain wheel 5. Dual chain wheel 5 is configured to handle at least two different chain sizes. As shown in FIGS. 1 and 3, dual chain wheel 5 is operatively coupled with messenger chain 10 and anchor chain 15. Dual chain wheel 5 may be the same as or similar to the dual chain wheel disclosed in U.S. patent application Ser. No. 13/669,310, the entirety of which is incorporated herein by reference. While rotary chain jack 100 is shown as including dual chain wheel 5, the rotary chain jack disclosed herein is not limited to dual chain wheels. For example, other embodiments of the rotary chain jack may include a single chain wheel.

Dual chain wheel 5 is rotatably coupled to frame 1 via axel 14. Frame 1 is mechanically coupled to a portion of offshore vessel 200, such as the deck. Frame 1 may be mechanically coupled to offshore vessel 200 via welding and/or bolting, for example. Drive assemblies 32, such as hydraulic or electric motors, are operatively coupled to gear assembly 6, and gear assembly 6 is operatively coupled to dual chain wheel 5. In some embodiments, drive assemblies 32 include a motor, gearbox, and pinion. Drive assemblies 32 operate to drive gear assembly 6, gear assembly 6 operates to drive dual chain wheel 5, and dual chain wheel 5 operates to pull-in or pay-out anchor chain 15 and/or messenger chain 10, depending upon the direction of rotation of dual chain wheel 5. When dual chain wheel 5 is not rotating, the position of anchor chain 15 and/or messenger chain 10 may be maintained.

Figure 5:
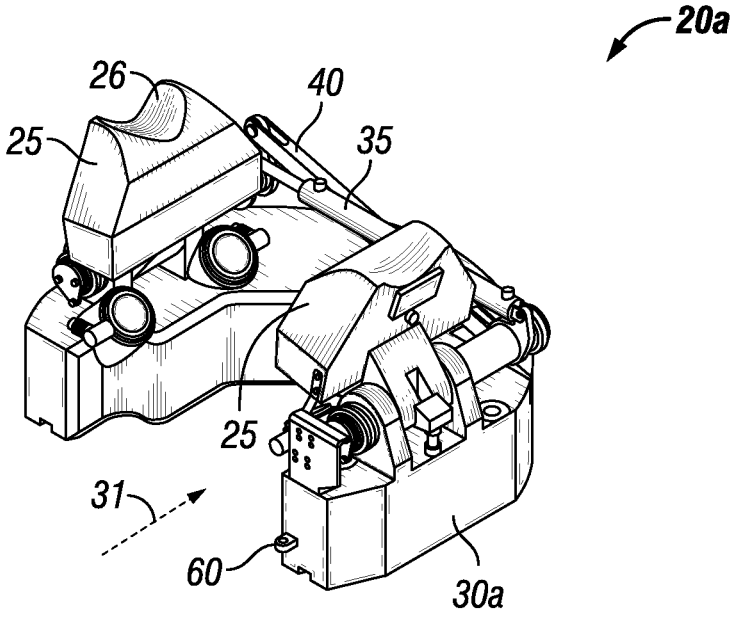
FIG. 5 is a perspective view of the chain stopper of FIGS. 1 and 3 with the latches in an open position.
Figure 6:
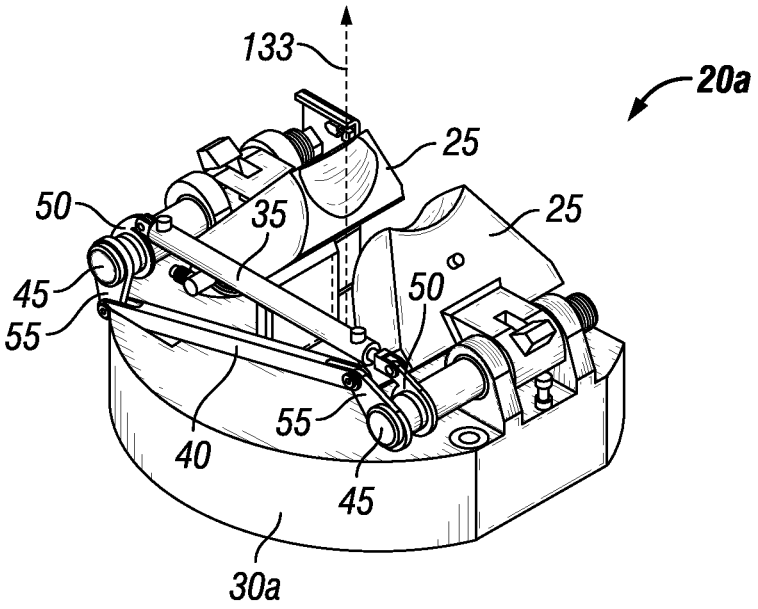
FIG. 6 is another perspective view of the chain stopper of FIG. 5 with the latches in a closed position.

Rotary chain jack 100 includes rotatable chain stopper 20*a*, which is depicted in isolation from rotary chain jack 100 in FIGS. 5 and 6. With reference to FIGS. 1, 3, 5 and 6, rotatable chain stopper 20*a* includes two latches 25 adapted to selectively engage with links of messenger chain 10 and anchor chain 15. Latches 25 are pivotably coupled to base 30*a* of rotatable chain stopper 20*a* via latch pins 45. Latches 25 are pivotable about latch pins 45 to move between an open position, as shown in FIG. 5, and a closed position, as shown in FIG. 6. In the open position, latches 25 are positioned to allow messenger chain 10 and/or anchor chain 15 to pass through rotatable chain stopper 20*a* without latches 25 engaging messenger chain 10 and/or anchor chain 15 (i.e., latches 25 are clear of messenger chain 10 and/or anchor chain 15). In the closed position, gripping surfaces 26 of latches 25 engage with links of messenger chain 10 and/or anchor chain 15 operatively positioned relative to rotatable chain stopper 20*a*. Gripping surfaces 26 may be concavities formed on the outer surface of latches 25 sized, shaped, and positioned to grip chains when latches are in the closed position. Latches 25 are disposed in opposing positions on base 30*a*, such that, when latches 25 are in the closed position, latches 25 grip messenger chain 10 or anchor chain 15 from opposite sides thereof.

Latches 25 are adapted to coordinately move between the open and closed positions. Latches 25 are responsive to latch actuator 35 and latch timing link 40, such that when latch actuator 35 is extended, latches 25 move into the open position, and when latch actuator 35 is retracted, latches 25 move into the closed position. Latch actuator 35 is operatively coupled to the upper side of both latch pins 45 via actuator connection arms 50. Latch actuator 35 may be a linear actuator, such as a hydraulic or pneumatic cylinder. In other embodiments, latch actuator 35 may be a rotary actuator. Actuator connection arms 50 extend above latch pins 45. Latch timing link 40 is operatively coupled to both latch pins 45 via timing levers 55. One of the timing levers 55 is generally aligned with an actuator connection arms 50, and one of the timing levers 55 is on the opposite side of latch pins 45.

Base 30*a* is sized to support latches 25, and the loads supported by latches 25. While base 30*a* is shown as having a generally circular shape, the base is not limited to this particular configuration, and may have another shape.

When installed on rotary chain jack 100, as shown in FIGS. 1 and 3, base 30*a* and latches 25 are positioned with respect to dual chain wheel 5 such that anchor chain 15 may be selectively secured by latches 25. For example, as shown, base 30*a* is positioned with respect to dual chain wheel 5 such that anchor chain 15 hangs through the center of base 30*a* and between latches 25 while the anchor chain 15 is engaged by chain wheel 5.

In the embodiment of rotatable chain stopper 20*a* shown in FIGS. 1, 3, 5 and 6, rotatable chain stopper 20*a* has an open "C" configuration. Base 30*a* includes open side 31. Open side 31 of base 30*a* is open with respect to dual chain wheel 5 and provides clearance for messenger chain 10. As described in more detail with respect to FIGS. 10-19, dual chain wheel 5 has an outer and inner ring of chain pockets, for operative engagement with anchor chain 15 and messenger chain 10, respectively. The inner ring of chain pockets is positioned closer to the wheel hub of dual chain wheel 5. The outer ring of chain pockets is sized to operatively engage the links of anchor chain 15. The inner ring of chain pockets is sized to operatively engage the links of messenger chain 10. As the position of the inner and outer rings are different, the chain hangs closer to the hub of dual chain wheel 5 when the messenger chain 10 is engaged with the chain wheel 5 than when anchor chain 15 is engaged with chain wheel 5, as explained in more detail below with reference to chain lines 38*a* and 38*b*. Open side 31 of base 30*a* is sized and positioned to accommodate the position of both messenger chain 10 and anchor chain 15 as the chains hang from dual chain wheel 5. Open side 31 is positioned to face dual chain wheel 5 when in a first position, and is positioned at least 90 degrees from dual chain wheel 5 (i.e., from first position) when in a second position.

Rotatable chain stopper 20*a* and base 30*a* are configured to rotate about axis 133 (shown in FIG. 6). In a preferred embodiment, a chain hangs along axis 133. When a chain hangs along axis 133, rotatable chain stopper 20*a* rotates about the chain. Rotatable chain stopper 20*a* rotates about axis 133 in response to actuator 56, such that actuator 56 initiates rotation of rotatable chain stopper 20*a*. Actuator 56 may be, for example and without limitation, a linear actuator, such as hydraulic or pneumatic cylinder. Actuator 56 is mechanically coupled to rotation arm 60 of base 30*a*. Actuator 56 may be fixed with respect to dual chain wheel 5. In operation, when actuator 56 is extended, actuator 56 pushes against rotation arm 60 such that base 30*a* rotates, thus rotating rotatable chain stopper 20*a*. In some embodiments, base 30*a*, and thus rotatable chain stopper 20*a*, is configured to be rotatable by at least 90 degrees about axis 133 in response to actuator 56. In certain embodiments, base 30*a* is configured to be rotatable by greater than 90 degrees about axis 133 in response to actuator 56. Although a 90 degree rotation is preferred, it is understood that the amount of rotation depends on the links of chain 15 and the need to align chain links with latches 25.

While anchor chain 15 is suspended within rotatable chain stopper 20*a*, ideally along axis 133, rotation of base 30*a* allows latches 25 to be selectively positioned to support either vertical links 15*a* or flat links 15*b* of anchor chain 15, depending on which is most closely aligned with latches 25. Thus, rotation of base 30*a* allows latches 25 to be selectively positioned to support anchor chain 15 irrespective of the orientation of the particular link adjacent latches 25. A chain jack in which latches are only capable of gripping vertical links or flat links is only capable of gripping every other link on the anchor chain. Thus, the ability of latches 25 to grip and support both vertical links 15*a* and flat links 15*b* of anchor chain 15 halves the resolution at which the mooring tension may be set by rotary chain jack 100.

Figure 9:
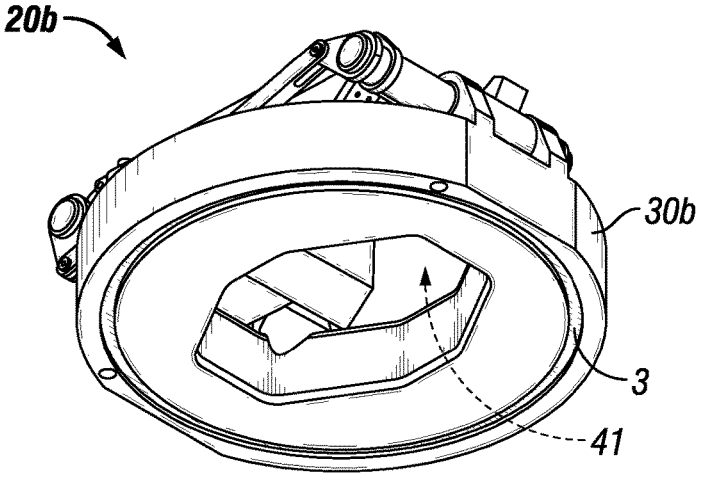
FIG. 9 is another perspective view of the chain stopper of FIG. 8 depicting a circular groove on a base of the chain stopper.
Figure 10:
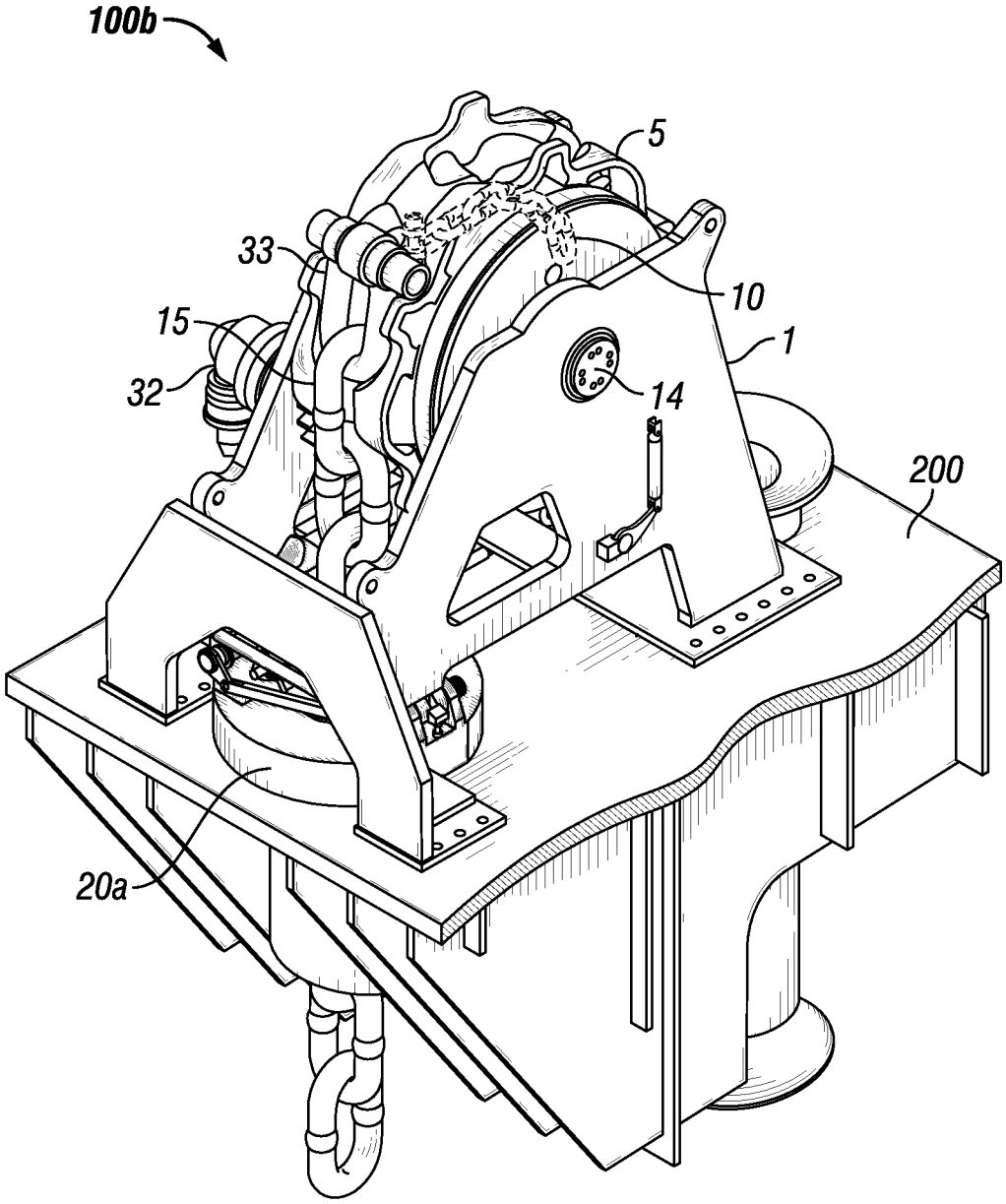
FIG. 10 is a perspective view of a dual chain mooring windlass in accordance with certain embodiments of the present disclosure.
Figure 11:
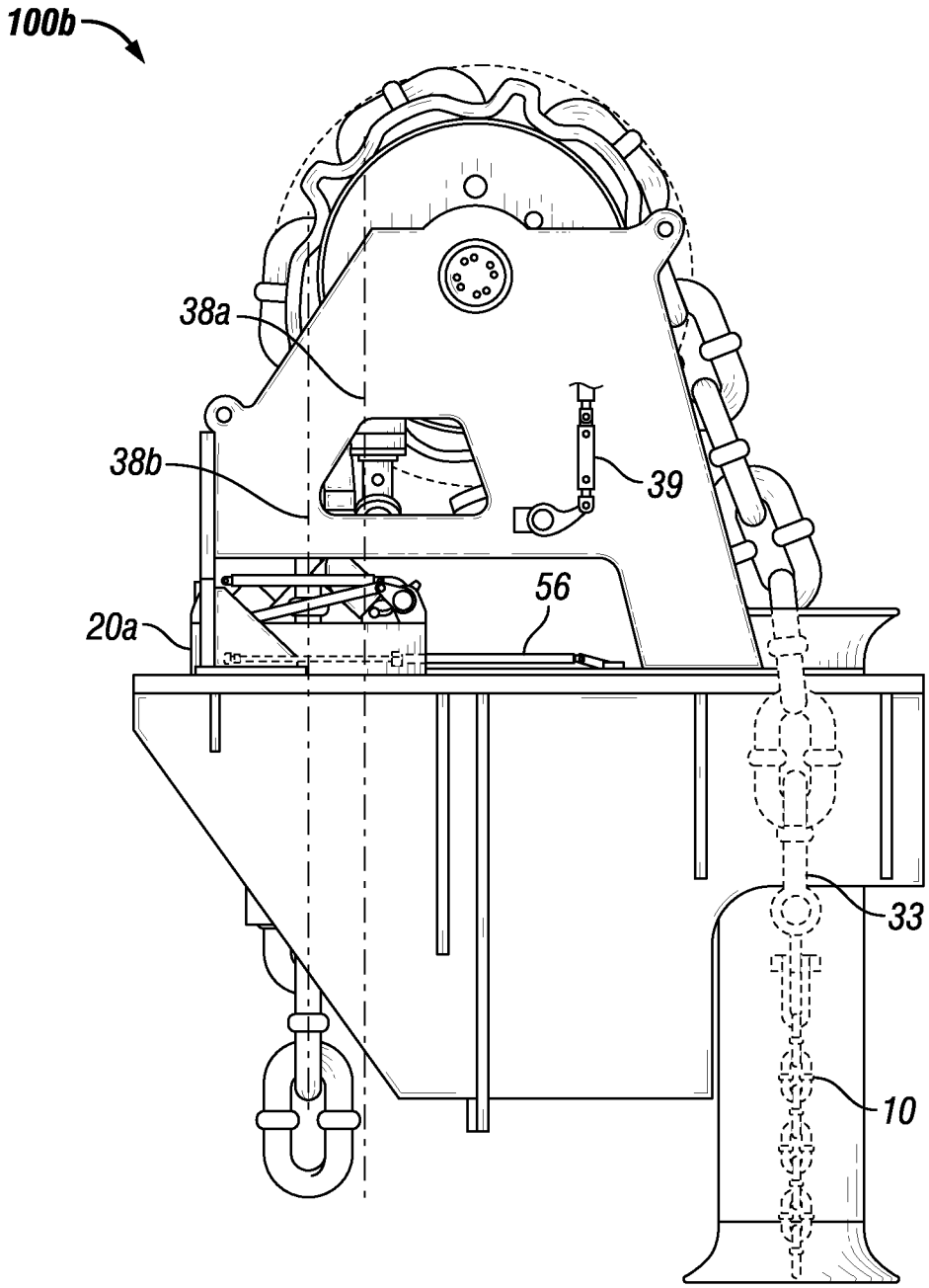
FIG. 11 is a side view of the dual chain mooring windlass of FIG. 10.

Base 30*a* may be coupled to a portion of offshore vessel 200 (e.g., a deck thereof) in a manner that maintains a position of base 30*a* relative to axis 133, while allowing a change in orientation of base 30*a* relative to axis 133 via rotation of base about axis 133. For example, base 30*a* may be rotatably coupled to the deck of offshore vessel 200 via a groove the same or similar to circular groove 3 of base 30*b* of linear chain jack 101, as shown in FIG. 9.

While rotatable chain stopper 20*a* is shown in FIGS. 1, 3, 5 and 6 as having opening 31, in other embodiments the base of the rotatable chain stopper does not have such an opening. Whether or not base has an opening may depend upon any of various operational parameters including, but not limited to, the type of messenger chain of rotary chain jack 100.

Linear Chain Jack

FIGS. 2 and 4 depict a linear chain jack with a rotatable chain stopper in accordance with certain embodiments of the present disclosure. Linear chain jack 101 includes linear actuators 103, upper chain stopper 120, and rotatable chain stopper 20*b*. As described in more detail below, in operation, upper chain stopper 120 operatively couples a chain passing there-through while linear actuators 103 raise or lower the chain by raising or lowering upper chain stopper 120. Rotatable chain stopper 20*b* performs the same function as rotatable chain stopper 20*a* described above, to selectively grip and support a vertical link 15*a* or flat link 15*b* of anchor chain 15. Thus, in the embodiment shown in FIGS. 2 and 4, the linear actuators 103 and upper chain stopper 120 are configured to pull-in and pay-out the anchor chain 15; whereas, in the embodiment shown in FIGS. 1 and 3, the dual chain wheel 5 is configured to pull-in and pay-out the anchor chain 15.

Linear actuators 103 may be hydraulic or pneumatic cylinders. Linear actuators 103 are operatively coupled to upper chain stopper 120, such as via bolting, and may also be mechanically coupled to an offshore vessel. In operation, linear actuators 103 extend to raise upper chain stopper 120, and retract to lower upper chain stopper 120. When upper chain stopper 120 is gripping and supporting an anchor chain, raising or lowering upper chain stopper 120 correspondingly raises or lowers the anchor chain, thereby pulling-in or paying-out the anchor chain along axis 133, respectively. When upper chain stopper 120 is not gripping and supporting an anchor chain, upper chain stopper 120 may be raised or lowered relative to the anchor chain. Upper chain stopper 120 includes open side 131 on base 130. Open side 131 may be sized and positioned to accommodate an anchor chain when linear chain jack 101 is being used to pull-in or pay-out the anchor chain.

To lift an anchor chain, linear chain jack 101 may be positioned in the retracted position, as shown in FIGS. 2 and 4, latches 125 may grip and support the anchor chain, and latches 25 may be in the open position such that latches 25 are not gripping or supporting anchor chain 15. Linear actuators 103 may then be extended until linear chain jack 101 is in the extended (lifted) position (not shown). Once linear chain jack 101 is in the extended position, latches 25 may move into the closed position such that latches 25 grip and support anchor chain 15. Once latches 25 are in the closed position, gripping and supporting anchor chain 15, latches 125 may be released from anchor chain 15 such that latches 125 are not gripping or supporting anchor chain 15. Latches 25 may then maintain a position of anchor chain 15. Linear actuators 103 may then be retracted to move linear chain jack 101 into the retracted position. The operation of linear actuators 103 and upper chain stopper 120 may be repeated as many times as desired to pay-out or pull-in anchor chain 15.

Latches 125 of upper chain stopper 120 may operate in substantially the same manner as described with respect to latches 25. For example, latches 125 are rotatably coupled to base 130 via latch pins 145, such that latches 125 are rotatable about latch pins 145 to move between an open position (not shown) and a closed position, as shown in FIGS. 2 and 4. Latches 125 are responsive to latch actuator 135 and latch timing link 140, such that when latch actuator 135 is extended, latches 125 move into the open position, and when latch actuator 135 is retracted, latches 125 move into the closed position. Latch actuator 135 is operatively coupled to the upper side of both latch pins 145 via actuator connection arms 150. Latch actuator 135 may be a linear actuator, such as a hydraulic or pneumatic cylinder. Actuator connection arms 150 extend above latch pins 145. Latch timing link 140 is operatively coupled to both latch pins 145 via timing levers 155. Timing levers 155 extend to opposite sides of latch pins 145.

Figure 7:
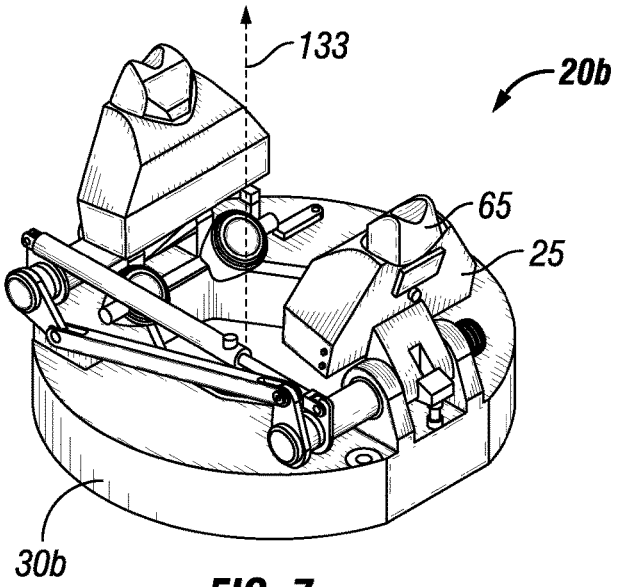
FIG. 7 is a perspective view of the chain stopper of FIGS. 2 and 4, including latch adapters.
Figure 8:
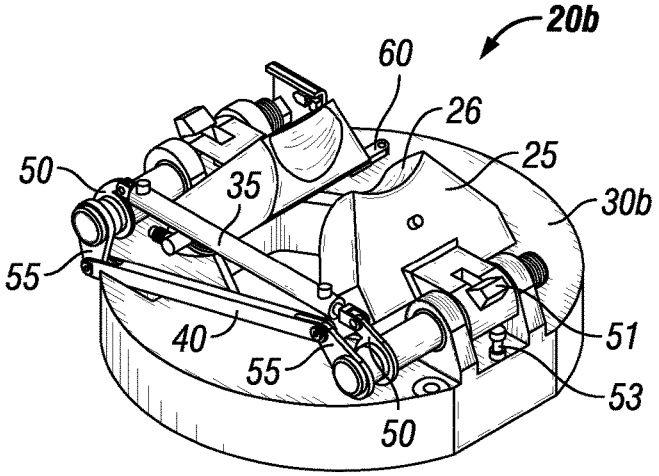
FIG. 8 is a perspective view of the chain stopper of FIGS. 2 and 4, without latch adapters.

FIGS. 7-9 depict rotatable chain stopper 20*b* of FIGS. 2 and 4, but in isolation from linear chain jack 101. Rotatable chain stopper 20*b* includes all components of rotatable chain stopper 20*a* as described with respect to FIGS. 1 and 3, with the exception that base 30*b* does not have opening 31, as does base 30*a*. Base 30*b* includes opening 41 through which an anchor chain may pass to be positioned in operative relation to latches 25 on base 30*b*.

The embodiment of rotatable chain stopper 20*b* shown in FIG. 7 includes latch adapters 65 coupled with latches 25. Latch adapters 65 may be attached to latches 25 to accommodate a smaller chain size, such as a messenger chain. As such, latch adapters 65 allow rotatable chain stopper 20*b* to grip chains having smaller dimensions than chains that can be griped with latches 25 without latch adapters 65. In some embodiments, latch adapters 65 may be manually installed onto latches 25. Latch adapters 65 are also shown in FIG. 2 on both latches 125 and latches 25.

Each latch 25 of rotatable chain stopper 20*b* includes bumper stop assembly, including bumper 51 on latch 25 and stop 53 on base 30*b*. In operation, when latch 25 moves into the open position, bumper 51 engages stop 53 to slow and/or stop further opening of latch 25. As such, the bumper stop assembly functions as a stop and/or damper for latch 25. While the bumper stop assembly is described with respect to rotatable chain stopper 20*b*, one skilled in the art would understand that the bumper stop assembly may be included in other embodiments of the rotatable chain stopper (e.g., rotatable chain stopper 20*a*).

Base 30*b* includes a top surface and a bottom surface opposite the top surface. In the embodiment shown in FIG. 9, base 30*b* includes circular groove 3 on the bottom surface thereof. Circular groove 3 is configured to mate with a cooperating shape attached to or part of offshore vessel 200, such as a circular ridge. In operation, circular groove 3 ensures that base 30*b* rotates about a fixed axis (e.g., axis 133). While circular groove 3 is shown on rotatable chain stopper 20*b*, but not on rotatable chain stopper 20*a*, it would be understood by one skilled in the art that a similar groove may also be on base 30*a* to ensure that base 30*a* rotates about a fixed axis (e.g., axis 133).

While linear chain jack 101 in FIGS. 2 and 4 is not shown coupled with an offshore vessel, it would be understood by one skilled in the art that linear chain jack 101 could be coupled to an offshore vessel, such as the one shown in FIGS. 1 and 3. Furthermore, linear actuators 103, with upper chain stopper 120, may be coupled with such an offshore vessel independently of rotatable chain stopper 20*b*. In some embodiments, rotatable chain stopper 20*b* is not mechanically coupled to linear actuators 103 or upper chain stopper 120.

In certain embodiments, linear actuators 103, with upper chain stopper 120, may be selectively coupled to an offshore vessel at different locations in relation to multiple, different rotatable chain stoppers 20*b*. As such, linear actuators 103, with upper chain stopper 120, may be selectively used with different rotatable chain stoppers 20*b* to raise and/or lower different anchor chains of the offshore vessel. Base 130 of upper chain stopper 120 may have opening 131, allowing for rotatable chain stopper 20*b* to be selectively positioned in operative relation to an anchor chain.

Operation of Rotary Chain Jack with Rotatable Chain Stopper

FIGS. 10-19 depict a chain mooring windlass including a rotatable chain stopper and the operation thereof in accordance with certain embodiments of the present disclosure. While operation of a rotary chain jack (chain mooring windlass) is discussed with respect to FIGS. 10-19, one skilled in the art would understand that the discussion is substantially applicable to the operation of a linear chain jack as well, with the exception that the rotational movement of the chain wheel is replaced with a linear, reciprocating motion of the linear actuators with the upper chain stopper.

With reference to FIGS. 10-19, chain mooring windlass 100*b* is shown, which is a rotary chain jack. Chain mooring windlass 100*b* includes dual chain wheel 5 rotatably mounted onto frame 1 via axel 14. Axel 14 extends through dual chain wheel 5. Frame 1 is mounted to a portion of offshore vessel 200.

Chain mooring windlass 100*b* includes drive assembly 32. Drive assembly 32 is operatively coupled dual chain wheel 5, which hauls anchor chain 15 into or towards inboard hawse pipe 135 or deploys anchor chain 15 outboard through outboard hawse pipe 136, depending upon the direction of rotation of dual chain wheel 5.

Chain mooring windlass 100*b* includes chain wheel latch cylinder 39 configured to ratchetedly engage with dual chain wheel 5. In the embodiment shown in FIGS. 10-19, chain wheel latch cylinder 39 ratchetedly engages dual chain wheel 5 with chain wheel latch 39*a*.

In some embodiments, anchor chain 15 may be mechanically coupled with an anchor (not shown). Anchor chain 15 is coupled with shackle 33. In operation, shackle 33 is configured to engage with teeth of dual chain wheel 5. Shackle 33 may be a back-to-back shackle connector. Shackle 33 is coupled with messenger chain 10. In this manner, a continuous chain of two different chain sizes is formed.

In the embodiment show in FIGS. 10-19, the small wildcat profiles of dual chain wheel 5 are sized and configured to couple with messenger chain 10. The large wildcat profiles of dual chain wheel 5 are sized and configured to couple with anchor chain 15, as discussed in U.S. application Ser. No. 13/669,310. In operation, while messenger chain 10 is hauled in, anchor chain 15 may extend along chain line 38*a*, and while anchor chain 15 is hauled in, anchor chain 15 may extend along chain line 38*b*.

The chain mooring windlass 100*b* shown in FIGS. 10-19 includes rotatable chain stopper 20*a*. Rotatable chain stopper 20*a* includes actuator 56 configured to selectively rotate rotatable chain stopper 20*a*, as described above.

Figure 13:
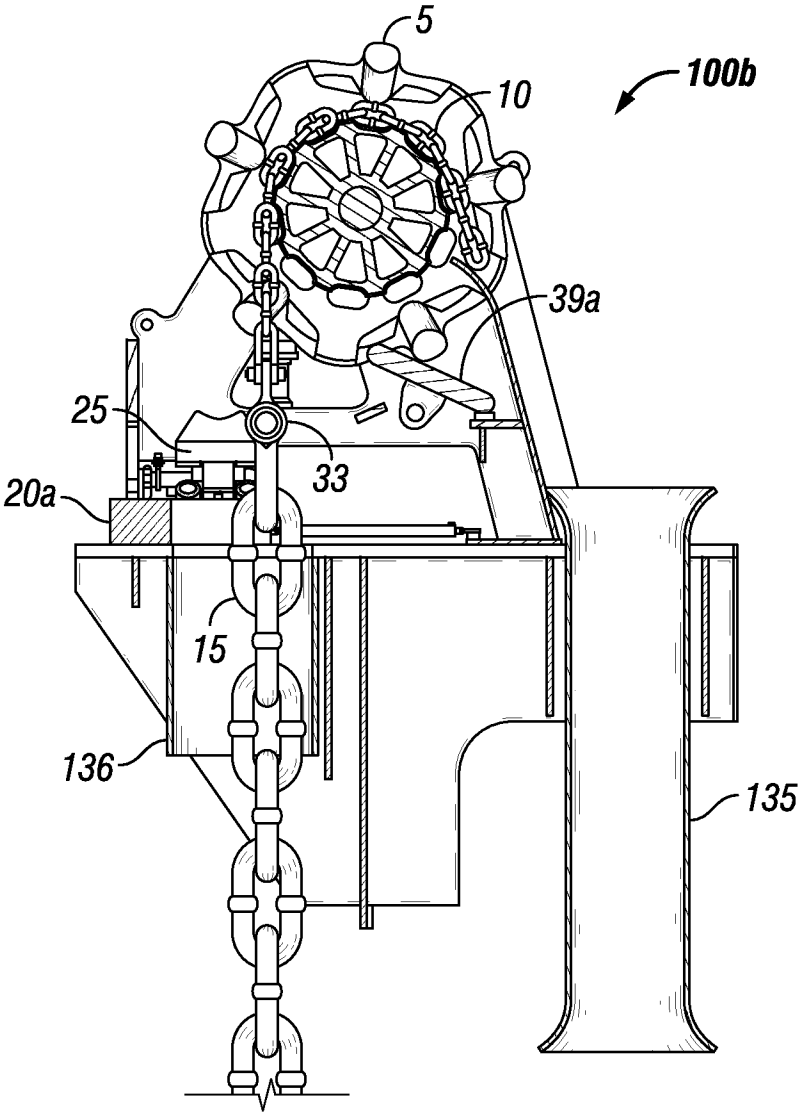
FIG. 13 is a cut-away, side view of the dual chain mooring windlass during haul-in of the messenger chain of FIG. 12.
Figure 12:
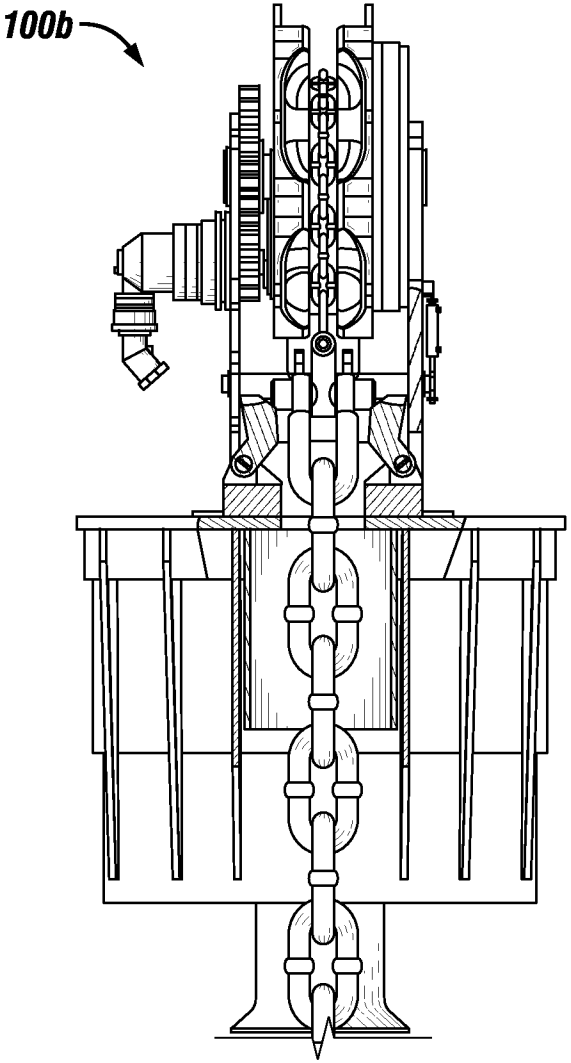
FIG. 12 is a cut-away, front view of a dual chain mooring windlass during haul-in of a messenger chain in accordance with certain embodiments of the present disclosure.

FIGS. 12-19 depict chain mooring windlass 100*b* in operation, in accordance with certain embodiments of the present disclosure. FIGS. 12 and 13 depict chain mooring windlass 100*b* during haul-in of messenger chain 10. During haul-in of messenger chain 10, latches 25 of rotatable chain stopper 20*a* are in the open position. When in the open position, as shown in FIGS. 12 and 13, chain line 38*a* passes inboard of stopper latches 25, by way of the open side of the "C" shaped rotatable chain stopper 20*a*. When chain line 38*a* is clear of rotatable chain stopper 20*a*, messenger chain 10 and shackle 33 do not engage latches 25 or the body of rotatable chain stopper 20*a*. In some embodiments, when chain line 38*a* is clear of rotatable chain stopper 20*a*, messenger chain 10 and shackle 33 do not engage or touch latches 25 or the body of rotatable chain stopper 20*a* as they are hauled-in or payed-out.

While the messenger chain 10 is being hauled in, chain wheel latch 39*a*, movable via chain wheel latch cylinder 39, is positioned to engage dual chain wheel 5. In some embodiments, chain wheel latch 39*a* ratchetedly engages dual chain wheel 5 as dual chain wheel 5 rotates. In the embodiment of FIG. 13, dual chain wheel 5 is rotated clockwise to haul-in messenger chain 10, shackle 33, and anchor chain 15.

Figure 15:
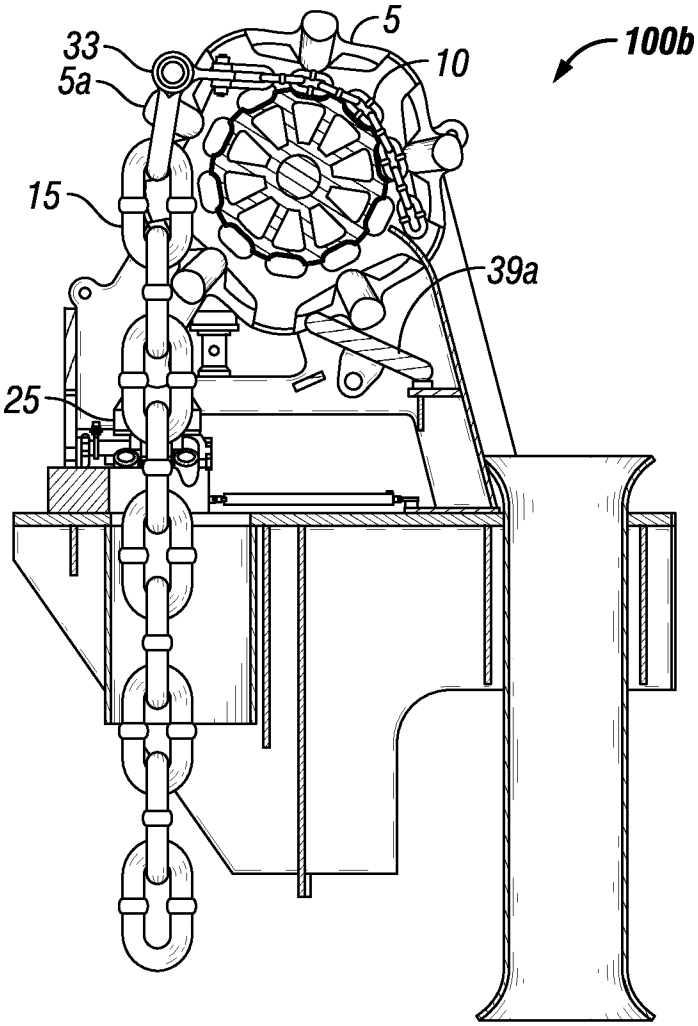
FIG. 15 is a cut-away, side view of the dual chain mooring windlass during transition from hauling in the messenger chain to hauling in the mooring chain of FIG. 14.
Figure 14:
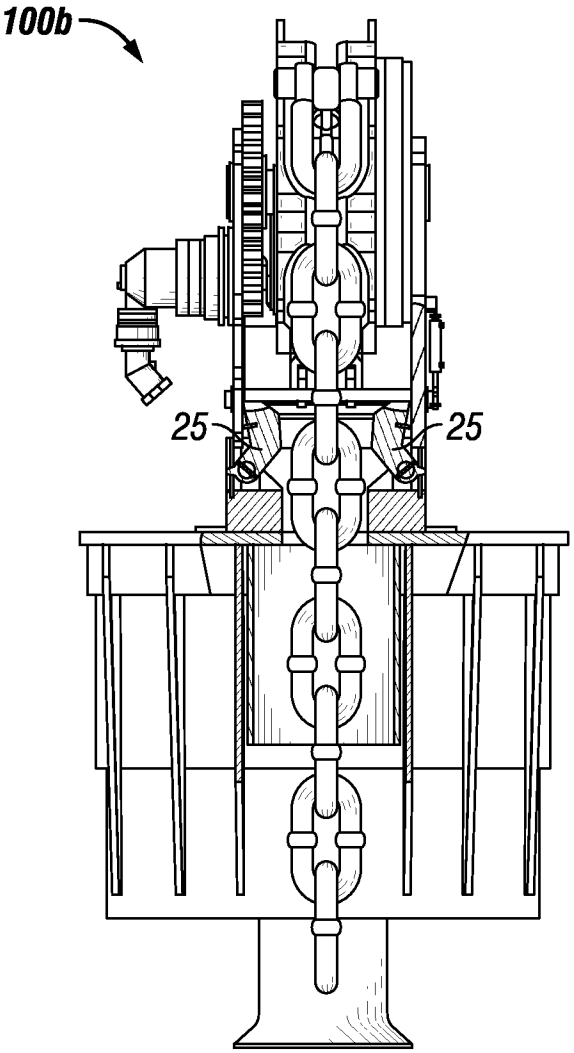
FIG. 14 is a cut-away, front view of a dual chain mooring windlass during transition from hauling in the messenger chain to hauling in a mooring chain in accordance with certain embodiments of the present disclosure.

FIGS. 14 and 15 depict chain mooring windlass 100*b* during transition from hauling in messenger chain 10, as shown in FIGS. 12 and 13, to hauling in anchor chain 15, as shown in FIGS. 16-19. During transition, shackle 33 engages tooth 5*a* of dual chain wheel 5. Tooth 5*a* is shaped to receive shackle 33. In some embodiments, chain wheel latch 39*a* ratchetedly engages dual chain wheel 5 during the transition.

During the transition, latches 25 of rotatable chain stopper 20*a* are in the open position to allow anchor chain 15 to pass freely as anchor chain 15 transitions from chain line 38*a* to chain line 38*b*.

FIGS. 16-19 depict top chain haul-in. During top chain haul-in, anchor chain 15 is engaged with dual chain wheel 5, and anchor chain 15 extends along chain line 38*b*. The center of rotation of rotatable chain stopper 20*a* may be a point located centrally between the two stopper latches 25. In embodiments described above, the center of rotation was shown as axis 133. In this manner, as rotatable chain stopper 20*a* rotates, latches 25 rotate about the center of rotation. In some embodiments, chain line 38*b* runs through the center of rotation.

Figure 17:
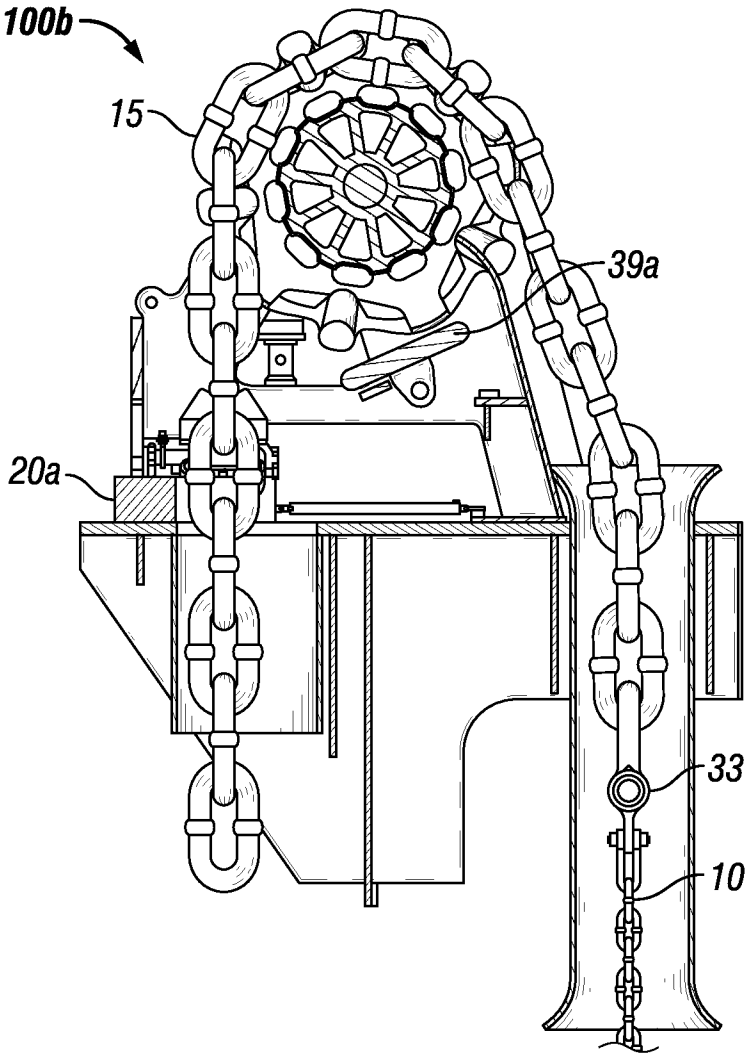
FIG. 17 is a cut-away, side view of the dual chain mooring windlass during haul-in of the mooring chain of FIG. 16.
Figure 16:
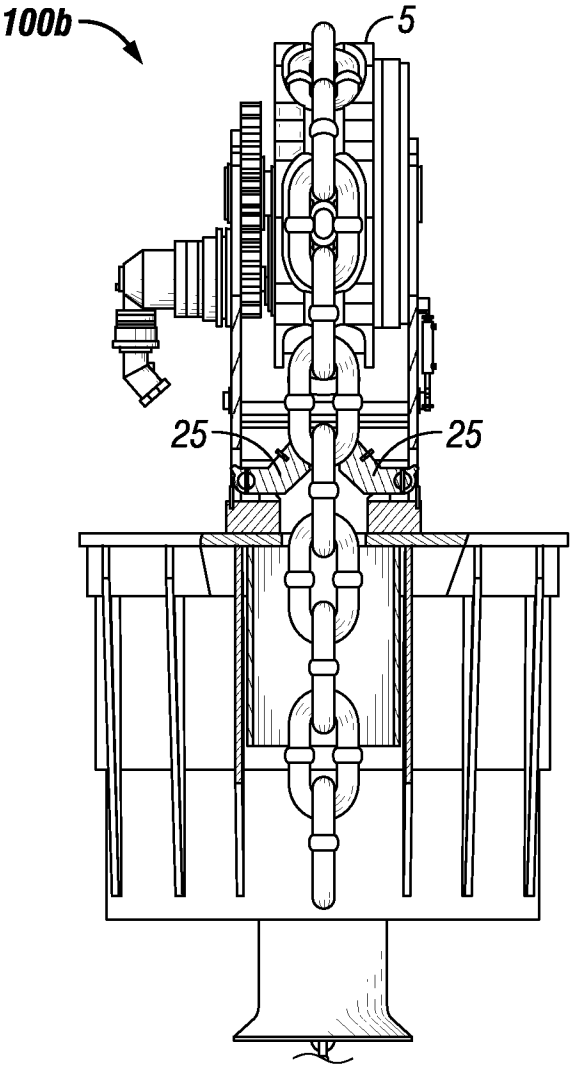
FIG. 16 is a cut-away, front view of a dual chain mooring windlass during haul-in of the mooring chain in accordance with certain embodiments of the present disclosure.
Figure 19:
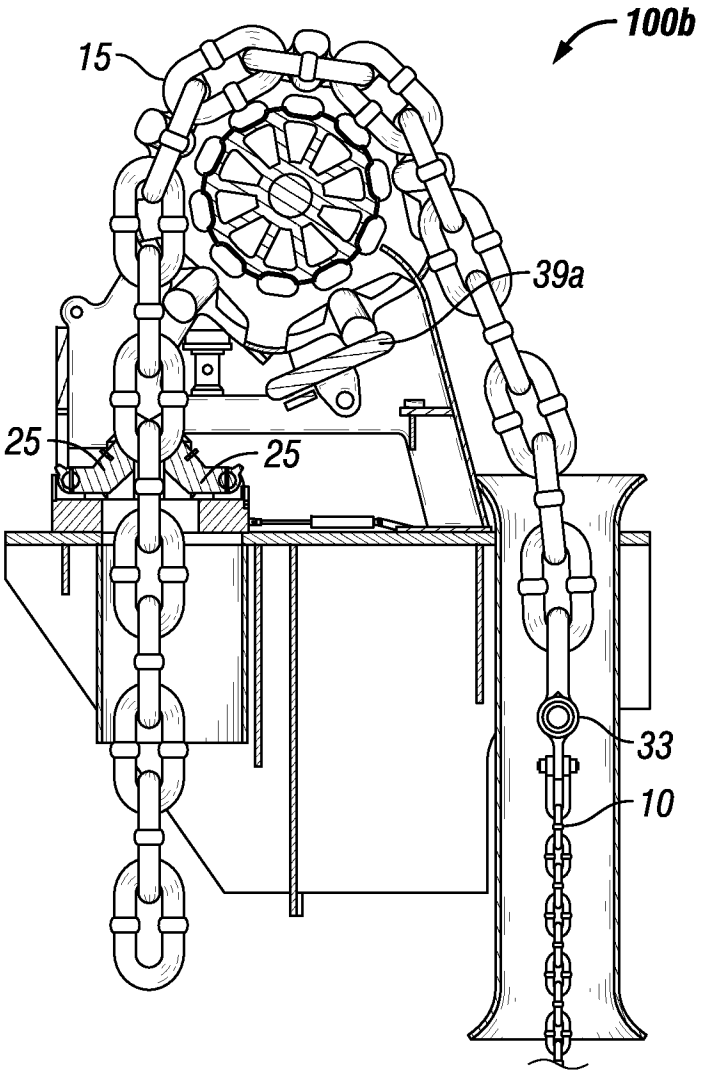
FIG. 19 is a cut-away, side view of the dual chain mooring windlass during positioning of the mooring chain of FIG. 18.
Figure 18:
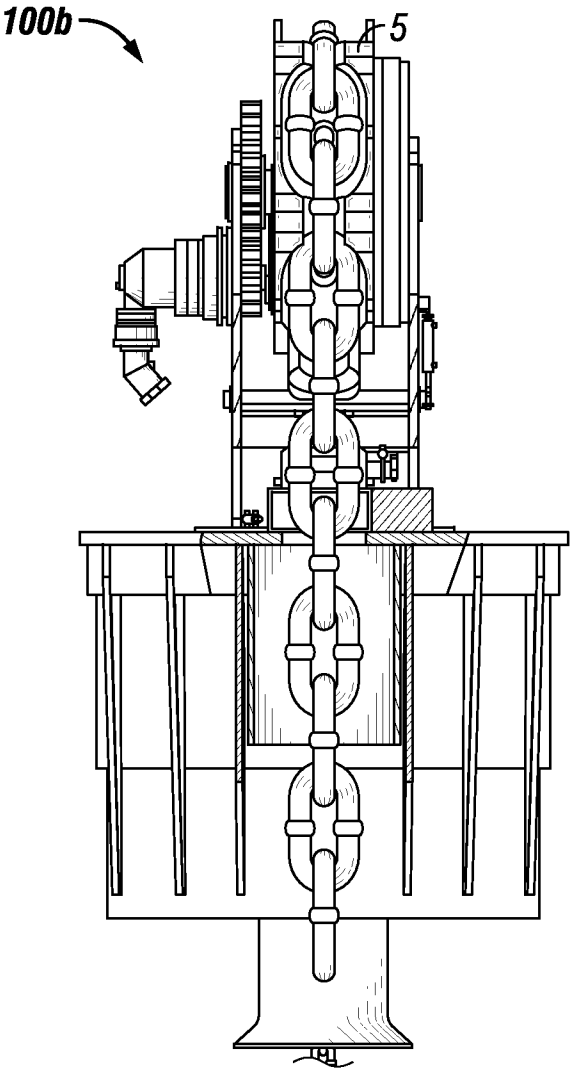
FIG. 18 is a cut-away, front view of a dual chain mooring windlass during positioning of the mooring chain in accordance with certain embodiments of the present disclosure.

During top chain haul-in, stopper latches 25 may be set to ratchetedly engage with links of anchor chain 15. In this manner, stopper latches 25 ratchet on the top part of alternating chain links. In some embodiments, stopper latches 25 rotate on the fly during top chain haul-in such that stopper latches 25 engage each sequential chain link passing through rotating chain stopper 20*a*. FIGS. 16 and 17 on the one hand, and FIGS. 18 and 19 on the other, show two positions in which stopper latches 25 can engage anchor chain 15. To precisely position anchor chain 15, anchor chain 15 may be hauled in via rotating dual chain wheel 5. Once in position, rotatable chain stopper 20*a* is positioned such that latches 25 may engage with a link of anchor chain 15 that minimizes the movement of anchor chain 15 when anchor chain 15 is set down upon, and in engagement with latches 25. In operation, rotatable chain stopper 20*a* is rotated, such as by 90°, so that latches 25 may engage any link (vertical or flat) of anchor chain 15. As such, anchor chain 15 can be more precisely positioned in that every link of anchor chain 15 can be engaged instead of every other link. Latches 25 secure and maintain position of anchor chain 15. During top chain haul-in and precise positioning of anchor chain 15, chain wheel latch 39*a* may be disengaged from dual chain wheel 5.

Chain Stopping Method

Other embodiments of the present disclosure include use of a chain stopper assembly in accordance with any of FIGS. 1-19 during pulling-in, paying-out, and/or positioning mooring lines to moor offshore vessels. Certain embodiments of such a method may be performed using chain stopper assembly 20*a* or 20*b*, as described with reference to FIGS. 1-19. Certain embodiments of such a method may be performed using a chain jack assembly (e.g., rotary chain jack 100 or linear chain jack 101) as described with reference to FIGS. 1-4, and 10-19.

The method includes pulling-in, paying-out, or combinations thereof an anchor chain using the chain jack (e.g., rotary chain jack 100 or linear chain jack 101). For example, the anchor chain may be pulled-in or payed-out via rotation of a chain wheel or reciprocating motion of a linear actuators with an upper chain stopper.

The method includes positioning latches to grip a link of the anchor chain. If the link to be gripped is a vertical link, the latches are positioned in a first position. If the link to be gripped is a flat link, the latches are positioned in a second position. Moving the latches from the first position to the second position is accomplished by rotating the rotatable chain stopper by, for example, 90 degrees. Rotating the rotatable chain stopper includes extending the actuator of the rotatable chain stopper.

The method includes gripping the link of the anchor chain with the latches. Gripping the link maintains a position of the anchor chain, such that the anchor chain is not pulled-in or payed-out while being gripped by the latches of the rotatable chain stopper.

In some embodiments, the method includes attaching latch adapters to the latches, and gripping a messenger chain coupled to the anchor chain with the latch adapters.

In embodiments of the method in which the chain jack is a rotary chain jack including a chain wheel, the step of pulling-in, paying-out, or combinations thereof the anchor chain includes rotating the chain wheel.

In embodiments of the method in which the chain jack is a linear chain jack including linear actuators and an upper chain stopper, the step of pulling-in, paying-out, or combinations thereof the anchor chain includes gripping the anchor chain with latches of the upper chain stopper, and raising, lowering, or combinations thereof the linear actuators. Raising or lowering the linear actuators results in a corresponding raising or lowering of the upper chain stopper, which, in-turn, results in a pulling-in or paying-out of the anchor chain. After gripping the link of the anchor chain with the latches of the rotatable chain stopper, the latches of the upper chain stopper are released from anchor chain.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A rotatable chain stopper assembly comprising:
a base;
latches coupled to the base; and
latch adapters coupled with the latches, wherein the latches are sized to grip a first chain size, wherein the latch adapters are sized to grip a second chain size, and wherein the second chain size is smaller than the first chain size.

2. The assembly of claim 1, wherein the latches are sized to grip an anchor chain, and wherein the latch adapters are sized to grip a messenger chain.

3. The assembly of claim 1, further comprising an actuator coupled to the base, wherein orientation of the base about an axis is responsive to the actuator.

4. The assembly of claim 1, further comprising a chain jack.

5. The assembly of claim 4, further comprising a chain coupled to the chain jack, and wherein the latch adapters are selectively rotatable to support either vertical links or flat links of the chain.

6. The assembly of claim 4, further comprising a chain coupled to the chain jack, wherein the latch adapters are pivotable between an open position and a closed position, wherein in the closed position the latch adapters grip a link of the chain, and wherein in the open position the latch adapters are clear of the chain.

7. The assembly of claim 4, wherein the chain jack is a rotary chain jack or a linear chain jack.

8. A rotatable chain stopper assembly comprising:
a base;
latches coupled to the base; and
latch adapters coupled with the latches;
wherein the latch adapters, coupled with the latches, are pivotable between an open position and a closed position.

9. A rotatable chain stopper assembly comprising:
a base;
latches coupled to the base; and
latch adapters selectively attachable and detachable with the latches
wherein the latches are sized to grip a first chain size, wherein the latch adapters are sized to grip a second chain size, and wherein the second chain size is smaller than the first chain size.

10. The assembly of claim 9, further comprising an actuator coupled to the base, wherein orientation of the base about an axis is responsive to the actuator, such that the latches, detached from the latch adapters, are selectively rotatable to support either vertical links or flat links of a first chain of the first chain size; and such that the latch adapters, attached with the latches, are selectively rotatable to support either vertical links or flat links of a second chain of the second chain size.

11. The assembly of claim 9, further comprising a chain jack.

12. The assembly of claim 11, further comprising a mooring line coupled to the chain jack, the mooring line including a first chain of the first chain size coupled with a second chain of the second chain size;
wherein the latches, detached from the latch adapters, are pivotable between an open position and a closed position, wherein in the closed position the latches grip a link of the first chain, and wherein in the open position the latches are clear of the first chain; and
wherein the latch adapters, attached with the latches, are pivotable between an open position and a closed position, wherein in the closed position the latch adapters grip a link of the second chain, and wherein in the open position the latch adapters are clear of the second chain.

13. The assembly of claim 12, wherein the first chain is an anchor chain and the second chain is a messenger chain.

14. A method of positioning an anchor chain, the method comprising:
providing a chain jack assembly comprising a chain jack and a rotatable chain stopper, the rotatable chain stopper comprising a base and latches coupled to the base;
pulling-in, paying-out, or combinations thereof a mooring line using the chain jack, the mooring line comprising an anchor chain coupled with a messenger chain;
attaching latch adapters to the latches;
positioning the latch adapters to grip a link of the messenger chain; and
gripping the link of the messenger chain with the latch adapters attached to the latches.

15. The method of claim 14, further comprising:
pulling-in, paying-out, or combinations thereof the mooring line using the chain jack;
removing the latch adapters from the latches;
positioning the latches to grip a link of the anchor chain; and
gripping the link of the anchor chain with the latches.

16. The method of claim 14, wherein, if the link is a vertical link, the latch adapters are positioned in a first position, and if the link is a flat link, the latch adapters are positioned in a second position, wherein moving the latch adapters from the first position to the second position includes rotating the rotatable chain stopper.

17. The method of claim 14, wherein the chain jack is a rotary chain jack including a chain wheel, and wherein pulling-in, paying-out, or combinations thereof the anchor chain includes rotating the chain wheel.

18. The method of claim 14, wherein the chain jack is a linear chain jack including linear actuators and an upper chain stopper, the upper chain stopper including a base, upper latches coupled to the base, and upper latch adapters coupled with the upper latches; and wherein pulling-in, paying-out, or combinations thereof the mooring line includes gripping the messenger chain with the upper latch adapters and raising, lowering, or combinations thereof the linear actuators.

19. The method of claim 18, further comprising gripping a link of the messenger chain with the latch adapters of the rotatable chain stopper; and, after gripping the link of the messenger chain with the latch adapters of the rotatable chain stopper, releasing the upper latch adapters of the upper chain stopper from messenger chain.

* * * * *